US007877947B2

(12) United States Patent
Borressen et al.

(10) Patent No.: US 7,877,947 B2
(45) Date of Patent: Feb. 1, 2011

(54) SYSTEM FOR BUILDING WITH GLASS BLOCKS

(75) Inventors: Bjorn Oddvar Borressen, Gamle Fredrikstad (NO); Jon Cato Olsen, Fredrikstad (NO); Lukas Zyznowski, Kungalv (NO)

(73) Assignee: QuickTech Systems AB, Kungalv (SE)

( * ) Notice: Subject to any disclaimer, the term of this patent is extended or adjusted under 35 U.S.C. 154(b) by 722 days.

(21) Appl. No.: 10/549,610

(22) PCT Filed: Mar. 19, 2004

(86) PCT No.: PCT/EP2004/002984

§ 371 (c)(1),
(2), (4) Date: Jun. 28, 2006

(87) PCT Pub. No.: WO2004/083549

PCT Pub. Date: Sep. 30, 2004

(65) Prior Publication Data

US 2007/0130859 A1 Jun. 14, 2007

(30) Foreign Application Priority Data

Mar. 20, 2003 (GB) ..... 0306423.5

(51) Int. Cl.
*E04B 2/56* (2006.01)

(52) U.S. Cl. ..... 52/306; 52/307; 52/308

(58) Field of Classification Search ..... 52/306, 52/307, 308, 396.06
See application file for complete search history.

(56) References Cited

U.S. PATENT DOCUMENTS

| | | | | | |
|---|---|---|---|---|---|
| 2,157,038 | A * | 5/1939 | Unverferth | 52/306 |
| 3,798,861 | A * | 3/1974 | Weiss | 52/306 |
| 4,058,943 | A | 11/1977 | Sturgill | |
| 4,774,793 | A * | 10/1988 | Mayer | 52/306 |
| 4,899,512 | A * | 2/1990 | DeGooyer | 52/308 |
| 4,986,048 | A * | 1/1991 | McMarlin | 52/306 |
| 5,430,985 | A * | 7/1995 | Coleman | 52/308 |
| 5,448,864 | A * | 9/1995 | Rosamond | 52/307 |
| 5,485,702 | A * | 1/1996 | Sholton | 52/308 |
| 5,740,646 | A * | 4/1998 | Wirkus et al. | 52/308 |
| 5,806,263 | A * | 9/1998 | Coleman | 52/306 |
| 5,845,443 | A | 12/1998 | Wirkus et al. | |
| 5,907,937 | A * | 6/1999 | Loftus et al. | 52/308 |
| 6,823,634 | B2 * | 11/2004 | Wright | 52/306 |
| 7,090,226 | B1 * | 8/2006 | Trainor et al. | 277/630 |
| 7,426,805 | B2 * | 9/2008 | Voegele et al. | 52/308 |
| 2004/0177577 | A1 * | 9/2004 | Voegele et al. | 52/306 |

FOREIGN PATENT DOCUMENTS

| | | |
|---|---|---|
| DE | 3309463 | 9/1984 |
| WO | WO02/12651 | 2/2002 |

* cited by examiner

*Primary Examiner*—Phi Dieu Tran A
(74) *Attorney, Agent, or Firm*—Coraline J. Haitjema; David P. Owen; Howrey LLP

(57) ABSTRACT

A system for building using glass blocks is disclosed which employs spacing strips. The spacing strips comprising elongate, generally planar elements having a cross section generally corresponding in shape to the intended spacing between two adjacent blocks in the completed construction. The spacing strips are hollow and may be provided with interior supporting webs. The strips are provided with adhesive which may be included during manufacture.

14 Claims, 4 Drawing Sheets

SYSTEM FOR BUILDING WITH GLASS BLOCKS

BACKGROUND OF THE INVENTION

1. Field of the Invention

The present invention relates to construction materials and methods and more particularly to a method for building using glass blocks and to a device for use with the method.

2. Description of the Related Art

Glass blocks have become increasingly popular in construction work and also in connection with the architectural decoration of both private dwellings and office or industrial buildings. In this context "glass block" is a generic term for generally right-angled, square or rectangular building blocks consisting basically of two sheets of glass that have been fused together. The sheets of glass may be patterned, rough, smooth and more or less transparent or translucent.

There is an air-filled cavity between the sheets of glass, which provides the glass block with good insulating properties both for sound and heat insulation. For this reason, such blocks are increasingly used for exterior walls or "windows" as well as for internal walls and partitions.

Because of the way they are made, even though they have high levels of rigidity and strength, glass building blocks of this kind are exposed to certain limitations as regards load. These limitations are largely determined by the skill and care with which the wall is assembled.

The classical building method when building with such glass blocks has been to lay a first course or layer of blocks with mortar between adjacent blocks. A layer of mortar is then laid along the top surface, followed by a second course of blocks. It has then been necessary to wait until an extensive degree of setting or hardening has taken place before further courses can be laid. Such methods of building are time-consuming and protracted.

More recently, alternative methods of building have been developed in which spacer members are placed between adjacent glass blocks. These spacer members may be formed of metal or plastics and are adapted to the edge profiles of the blocks. They are also carefully dimensioned to ensure the desired spacing between courses and also between adjacent blocks on the same course. Various different methods have been used to maintain the blocks together. According to the disclosure of U.S. Pat. No. 5,484,702, an assembly of glass blocks provided with spacers may be completely surrounded by a metal or polyester strip, which serves to bind them together. Such a construction is inherently impractical and relies on the successful tensioning of the strip. The possibility of building curved walls incorporating such a strip is not foreseen.

It has also been proposed to use spacing strips provided with recesses or channels for receiving a sealant or silicone caulking agent. Such arrangements allow the glass blocks to be effectively glued together using the sealant. Because the spacing between the blocks is determined by the spacing strip, it is possible to build a complete wall in one procedure without the inconvenience of waiting for mortar to harden. The sealant provides the required strength after drying and further rigidity is provided by grout applied to the joints between the glass blocks thereby covering the edges of the spacing strips. A method of building using such spacing strips and sealant has been previously disclosed in WO02/12651.

Prior art spacing strips are of a generally solid construction. A commonly used material in the past has been wood or wood composite. While such constructions have been found to provide the necessary strength for support of glass block walls, they have been found to be adversely affected by moisture. Alternative spacing strips have been considered using plastics materials but these have been found relatively heavy and expensive to produce due to the amount of material required. Additionally, problems have been encountered in achieving the necessary strength required to meet various building standards. In this respect, the strength of the spacing strip in compression and shear and the strength of the bond between the spacing strip and the adhesive medium and between the adhesive medium and the glass block must all meet the required standards.

BRIEF SUMMARY OF THE INVENTION

According to the present invention there is provided a generally planar spacing strip of plastics material, having upper and lower surfaces forming an outer cross section generally corresponding in shape to the intended spacing between two adjacent blocks in the completed construction, the spacing strip having a generally hollow interior with relatively thin upper and lower walls. According to this aspect, the spacing strip is easy to manufacture using extrusion techniques is light and material-efficient and also has excellent insulation properties.

Preferably, the spacing strip comprises a body portion having a first thickness and having a centrally disposed elongate channel on upper and lower surfaces thereof, and flange portions having a second thickness less than the first thickness, the flange portions extending laterally from the body portion.

It has been found particularly desirable that the hollow interior of the body portion comprises transverse reinforcing webs. Preferably the lateral extending flanges are also at least partially hollow and may also comprise transverse reinforcing webs. The hollow profile spacing strip may be formed by extrusion, preferably of polystyrene or PVC.

Preferably, the adhesive is a one-component polymer adhesive or non-reactive adhesives of the type that hardens by evaporation of a solvent leaving a polymeric binder behind. It has been found extremely important that the solvent be carefully adapted to the material of the spacing strip and also to the surface of the glass block. The solvent should preferably react with the spacing strip material just sufficiently to slightly dissolve a surface layer thereof and enhance bonding. Excess or over reactive solvents can cause the spacing strip to deform and the structure to be weakened. Ideally the solvent used may be an alkane or cycloalkane, such as methylcyclohexane or the like.

According to one aspect of the present invention, it has been found that a particularly strong construction can be achieved using a spacing strip formed of polystyrene or other styrene-based polymer in combination with an adhesive containing a polymer or copolymer or block (co) polymer having aliphatic or styrenic groups which compatibilise the polymer with styrene. In this way, once the solvent has partially dissolved a surface layer of the polystyrene spacing strip, the polymer of the adhesive may form a chemical bond with the strip material. Ideally, by providing an appropriate coating to the surface of the glass block a similar reaction will take place at this interface.

The application of adhesive may be achieved using a sealant gun or dispenser to deliver a line of adhesive. The application of adhesive can be a somewhat messy affair. While skilled professionals may have appropriate tools facilitating dispensing, today's do-it-yourself enthusiast usually possesses only the standard tube-dispensing pistol. Using such dispensers, it is extremely difficult to provide a consistent application of adhesive along the whole length of a spacing strip. If the adhesive is applied too thickly, it may prevent the block from fully bedding on to the spacing strip. If it is applied too thinly, it may fail to provide contact between the strip and the hollow edge-surface of the block.

According to a further aspect of the present invention it has been found desirable to provide spacing strips for the construction of block walls, the spacing strips being provided during manufacture with a measured quantity of adhesive sufficient to ensure adhesion between the strip and a block.

Such spacing strips may be provided with the correct quantity of adhesive during manufacture and sold as prepared strips. The person desiring to construct a glass block wall need then only purchase the blocks and the strips in order to commence construction of the wall. Separate purchase of adhesive or sealant is thus no longer necessary. The addition of the adhesive during manufacture also serves to ensure the correct, accurate distribution of the adhesive over the surface of the strip.

According to an advantageous embodiment of the invention, the adhesive may be provided with a removable protective layer, which assures the efficacy of the adhesive despite extended storage.

The adhesive may be a silicon sealant-type adhesive and may preferably be provided in a channel of the spacing strip.

Alternatively, the adhesive may be a contact adhesive provided as a thin layer for adhesion between lateral edges of the spacing strip and the weight-bearing surfaces of the blocks. An advantage of the use of a contact-type adhesive is that it provides instant immobilisation of the blocks allowing following courses to be laid immediately without waiting for the adhesive to set.

According to a particular embodiment of the present invention the spacing strip may be provided with two different adhesives. By using two types of adhesive it is possible to provide a first adhesive ensuring an initial instant adhesion between the blocks for stability during construction followed by an increased-strength joint on hardening or curing of the second adhesive.

Preferably, the first adhesive is a releasable adhesive allowing repositioning of the block during its initial placement.

Alternative types of adhesive may be used including multi-component adhesives and temperature activated adhesives. It may for instance be desirable to provide a first component of an adhesive on the spacing strip and a second component on the block whereby, upon bringing the strip and the block together, the adhesive is activated According to a particularly advantageous embodiment of the present invention it has been found that, by using a tacky adhesive, sufficient strength can be achieved to build a glass block structure without requiring further hardening adhesives or mortars. Accordingly, a method of building using glass blocks is disclosed, the glass blocks being provided with load-supporting contact faces around their periphery, in which a spacing strip having laterally extending flanges is provided with a layer of tacky adhesive on the surfaces of the flanges. The spacing strip is placed on a first glass block with the flanges overlying the contact faces. A second glass block is placed onto the spacing strip whereby the flanges are sandwiched between the respective contact faces of the first and second glass blocks.

In this context, a tacky adhesive is understood to be one which provides a joint with instant adhesion but which may be subsequently broken and rejoined without substantial loss of adhesion. The degree of tackiness may be determined according to the intended structure. For permanent structures, the tackiness or strength of the adhesive bond should be sufficient to withstand the building requirements, in particular for lateral forces, for such structures. For temporary structures, e.g. for displays and exhibitions, lower values of tack may be used whereby the glass block structure may be more easily disassembled.

While the invention has been described wherein the adhesive is provided on the spacing strip, it is recognised that similar advantages could be achieved by providing the adhesive on the glass blocks themselves.

BRIEF DESCRIPTION OF THE DRAWINGS

An embodiment of the present invention will now be described in more detail with reference to the attached figures, in which.

DESCRIPTION OF ILLUSTRATIVE EMBODIMENTS

Figure 1:
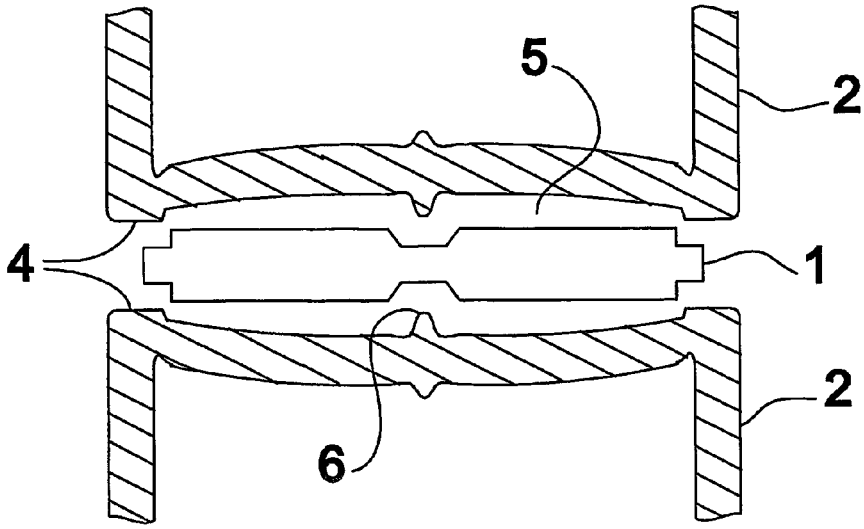
FIG. 1 is an exploded cross-section of a spacing strip disposed between two glass blocks prior to assembly.

FIG. 1 shows a view of a spacing strip 1 positioned between a pair of glass blocks 2. The cross-sectional shape of the spacing strip 1 is dependent upon the type of glass block 2 used, but such glass blocks 2 are essentially standardised. Around either edge of their periphery, the glass blocks 2 are provided with contact faces 4. The contact faces 4 are the areas of greatest supporting strength of the glass block, since they are aligned with the front and rear glass walls that form the faces of the glass blocks 2. Between the contact faces 4 a recess 5 is formed which extends around the periphery. Within the recess 5, the glass blocks 2 also have a boss 6 extending essentially around the middle of their periphery. The boss 6 extends outwards to a greater or lesser extent and is formed as a seam on joining of the two halves of a glass block 2 during manufacture. When building with such glass blocks, the weight of the glass block 2 is carried by the contact faces 4 which form a stable support. The recess 5 ensures that the boss 6 is held free of the surface on which the glass block 2 is resting.

Figure 2:
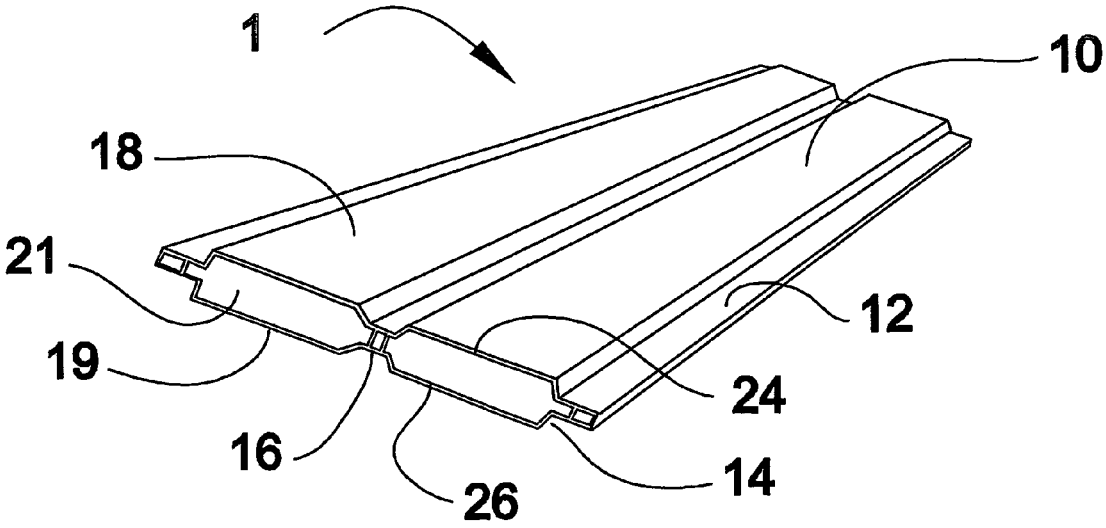
FIG. 2 is a perspective view of a spacing strip according to an embodiment of the present invention.

With reference to FIG. 2, it can be seen that the spacing strip 1 is an elongate strip comprising a central body portion 10 of generally rectangular cross-section. The body section 10 is provided with laterally extending flanges 12 extending from the side faces 14. An elongate central channel 16 is formed in each of the top and bottom faces 18, 19 respectively. The spacing strip 1 has a generally hollow interior 21 with relatively thin upper 24 and lower walls 26.

Figure 3:
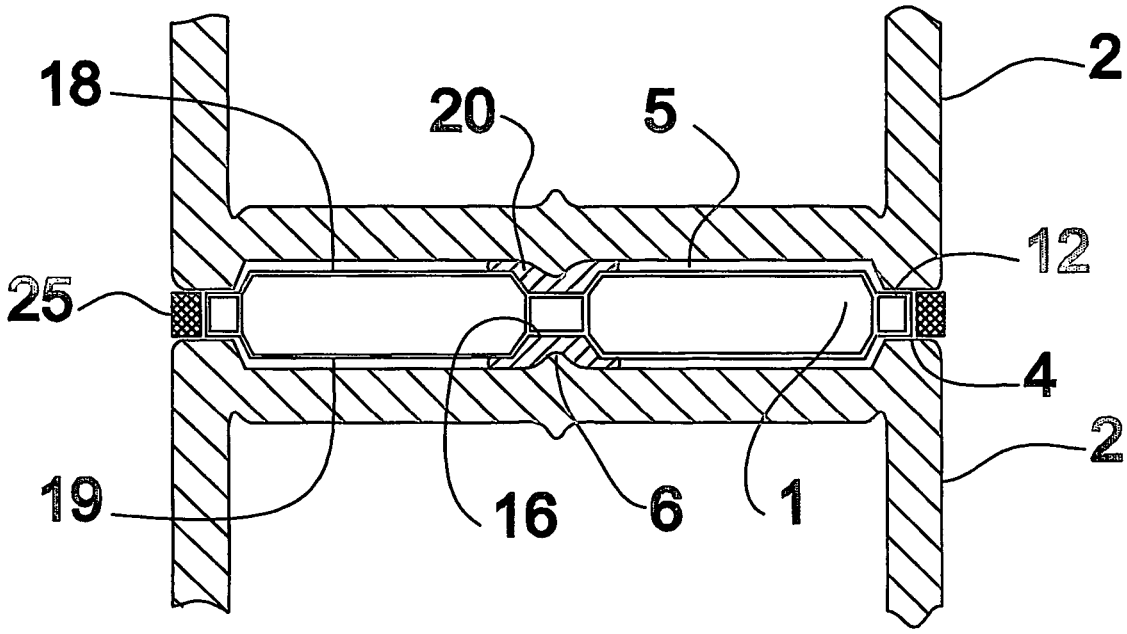
FIG. 3 shows a cross-section similar to FIG. 1 in the assembled condition.

An assembly of a pair of glass blocks 2 by means of a spacing strip 1 according to FIG. 2 is shown in cross-section in FIG. 3. According to FIG. 3, it can be seen how the contact faces 4 seat on the laterally extending flanges 12. The thickness of these flanges 12 is thus determinative for the spacing between adjacent glass blocks 2. This spacing will depend upon the overall appearance desired but will usually be between 5 mm and 10 mm. From FIG. 3, it can also be seen how the bosses 6 of the glass blocks 2 locate within the channels 16. This has a dual function. Firstly, the channels 16 ensure that the bosses 6 are free of the spacing strip 1 and cannot bear any load (which should be borne mainly by the contact faces 4). Secondly, according to this embodiment of the invention, the channels 16 can serve as deposits for an adhesive 20. After providing adhesive to the channels 16 and on assembly of the construction, the bosses 6 enter into the recesses 16 and displace a quantity of the adhesive. This causes the adhesive 20 to well up around the boss 6, increasing the contact. It also causes the adhesive 20 to be spread out within the recesses 5 and over the top and bottom faces 18, 19 of the spacing strip.

FIGS. 1 and 3 also illustrate how the spacing strip 1 may be narrower than the width of the glass blocks themselves. According to FIG. 3, after assembly of the construction, the gaps between adjacent glass blocks 2 may be filled with grout 25 in the normal way. Alternatively, any other appropriate product or device may be used to fill this gap including, but not limited to, adhesives, caulking agents and additional plastic or rubber profile strips. Alternatively, the lateral flanges 12 may be made longer to fill the gap completely and may also be provided with decorative or sealing edges to provide any desired aesthetic or functional effect.

The spacing strip 1 according to FIGS. 1 to 3 may be of any suitable plastics material. Preferably the spacing strip 1 is formed of materials which are easily formed by extrusion techniques, making it cheap and environmentally acceptable. Advantageously, the spacing strip 1 should be sufficiently rigid to support the weight of the glass block structure and should be selected to be compatible with the intended adhesive. Qualities such as sound, heat and vibration insulation are also desirable, as well as resistance to deterioration in the intended environment of use. A particularly suitable material is polystyrene. Polyvinyl-chloride PVC may also be used.

The adhesive 20 used in the embodiment of FIG. 3 may be a one-component polymer adhesive. According to a particular aspect of the present invention the adhesive 20 contains a polymer or copolymer or block (co-) polymer having aliphatic or styrenic groups which compatibilise the polymer with styrene. This has been found to provide a particularly strong construction in combination with a spacing strip formed of polystyrene or other styrene-based polymer.

Figure 4:
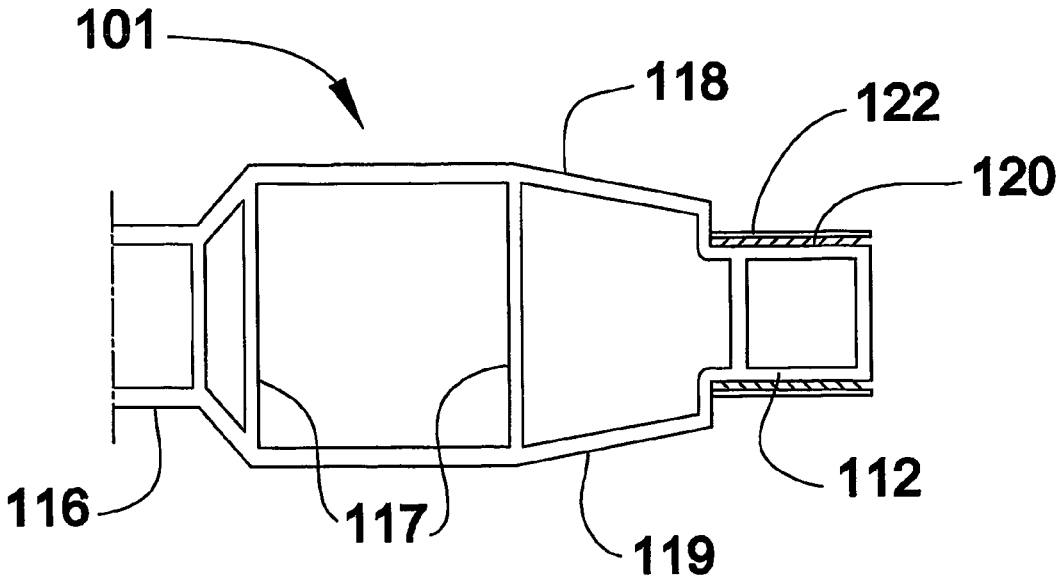
FIG. 4 shows a cross-section of an alternative embodiment of a spacing strip according to the present invention.

FIG. 4 shows a detail of a spacing strip 101 according to a further aspect of the present invention. The spacing strip 101 comprises webs 117 which support thin upper and lower surfaces 118, 119 to provide structural rigidity to the structure. The upper and lower surfaces 118, 119 in this embodiment are also not completely parallel to one another and are instead slightly adapted to the inner profile of the glass blocks. Advantageously, the hollow structure of the spacing strip 101 is easy to manufacture using extrusion techniques; it is light and material-efficient and also has excellent insulation properties.

According to an alternative aspect of the present invention, the spacing strip 101 illustrated in FIG. 4 also differs from the embodiment shown in FIG. 2 in that the upper and lower surfaces of the lateral flanges 112 are provided with an adhesive layer 120. The adhesive layer is provided before use with a peel-away cover sheet 122.

In use, the cover sheet 122 is removed from the lower surfaces of both flanges 112. The spacing strip 101 is placed onto a first glass block, usually one which already forms part of a wall under construction. Next, the cover sheets 122 are removed from the upper surfaces of the lateral flanges 112 and a second block is placed onto or against the first glass block such that the lateral flanges 112 are sandwiched between adjacent contact surfaces 4 of the first and second glass blocks. Pressure may be exerted to the joint but, under normal circumstances, for the horizontal strips, the weight of the glass blocks themselves provides sufficient pressure.

The spacing strip of FIG. 4 may be formed of any appropriate material that can be extruded into the desired shapes. Such materials may include PVC and other relatively rigid plastics. Polystyrene has been found to be a particularly advantageous material, which is more environmentally friendly than PVC. Although polystyrene is subject to degradation by UV light, once it is included within a glass block structure, it is effectively protected against such degradation.

The adhesive 120 used in the embodiment of FIG. 4 is preferably a contact type of adhesive which may be reactive or non-reactive. Reactive adhesives are ones that undergo a reaction to form a bond and thereafter cannot be removed without permanently breaking the bond. Such adhesives may include heat-activated adhesives, UV light-activated adhesives, pressure-activated adhesives or the like or adhesives activated by solvent evaporation.

Non-reactive adhesives may be used that form a tacky bond with at least one of the surfaces. Such non-reactive adhesives are advantageous in that they can provide an instant bond as in the case of adhesive tapes. They are also removable and can be reapplied a number of times without substantial loss of adhesion. The degree of tackiness may be determined according to the intended structure. For permanent structures, the tackiness or strength of the adhesive bond should be sufficient to withstand the building requirements, in particular for lateral forces, for such structures. For temporary structures, e.g. for displays and exhibitions, lower values of tack may be used whereby the glass block structure may be more easily disassembled. Ideally the degree of tack of the adhesive to the spacing strip 101 should be greater than that to the glass block 2, ensuring that, on removal, the adhesive remains attached to the spacing strip. In this way, glass blocks 2 may be easily reused.

It is also possible to combine a number of adhesive systems to form a wall. It is thus possible to provide a spacing strip according to FIG. 3 with a further quantity of adhesive applied to the lateral flanges as in FIG. 4 and vice versa. One of the adhesives may be provided during manufacture, while the other may be applied during construction of the wall. Advantageously, a spacing strip 1, 101 may be provided with a tacky-type adhesive on its lateral flanges 12, 112 and a quantity of hardening adhesive in the central channel 16, 116 or on the upper and lower surfaces 18, 19, 118, 119. The tacky adhesive provides initial stability during assembly of the wall and allows the construction to proceed more quickly. The silicon provides added long-term strength and stability upon fully setting.

For the construction of glass block structures using adhesive applied only between the lateral flanges 12, 112 and the contact faces 4, it is possible to dispense with the profiled shape of the spacing strip and use essentially flat strips having the thickness of the required joint between adjacent glass blocks 2.

Figure 5:
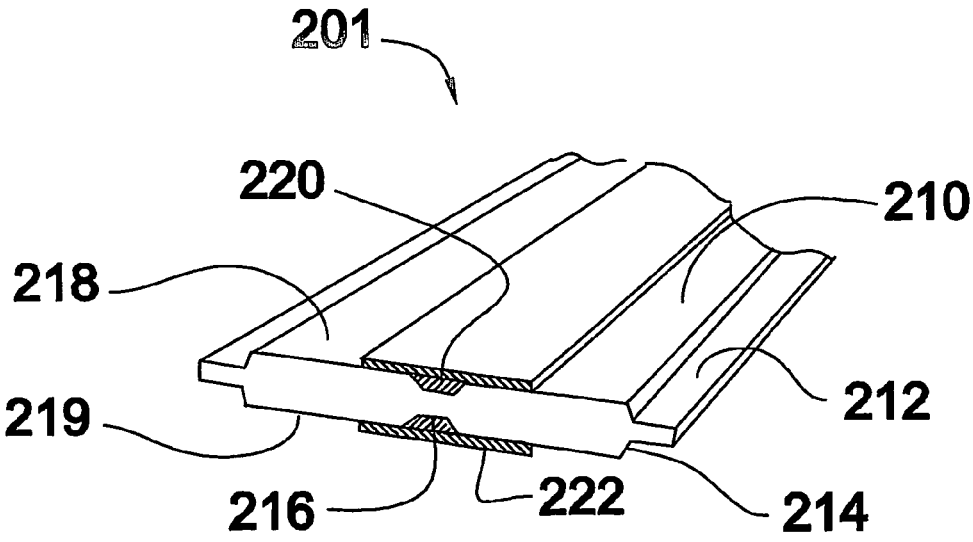
FIG. 5 shows a cross-section of a second alternative embodiment of the spacing strip according to the invention.

FIG. 5 shows a perspective view of a spacing strip 201 according to an alternative aspect of the invention. As in FIG. 4, spacing strip 201 is provided with a quantity of pre-applied adhesive 220. The adhesive is located in the central channel 216 and is covered with a peelable cover strip 222. The internal hollow construction of the spacing strip 201 is not shown, but may be similar to that of FIG. 2 or FIG. 4.

The spacing strips 1, 101, 201 may be supplied in lengths, which are then cut to the required size. Alternatively or additionally, they may be provided in individual short lengths corresponding to the dimensions of a side of a single glass block 2.

Figure 6:
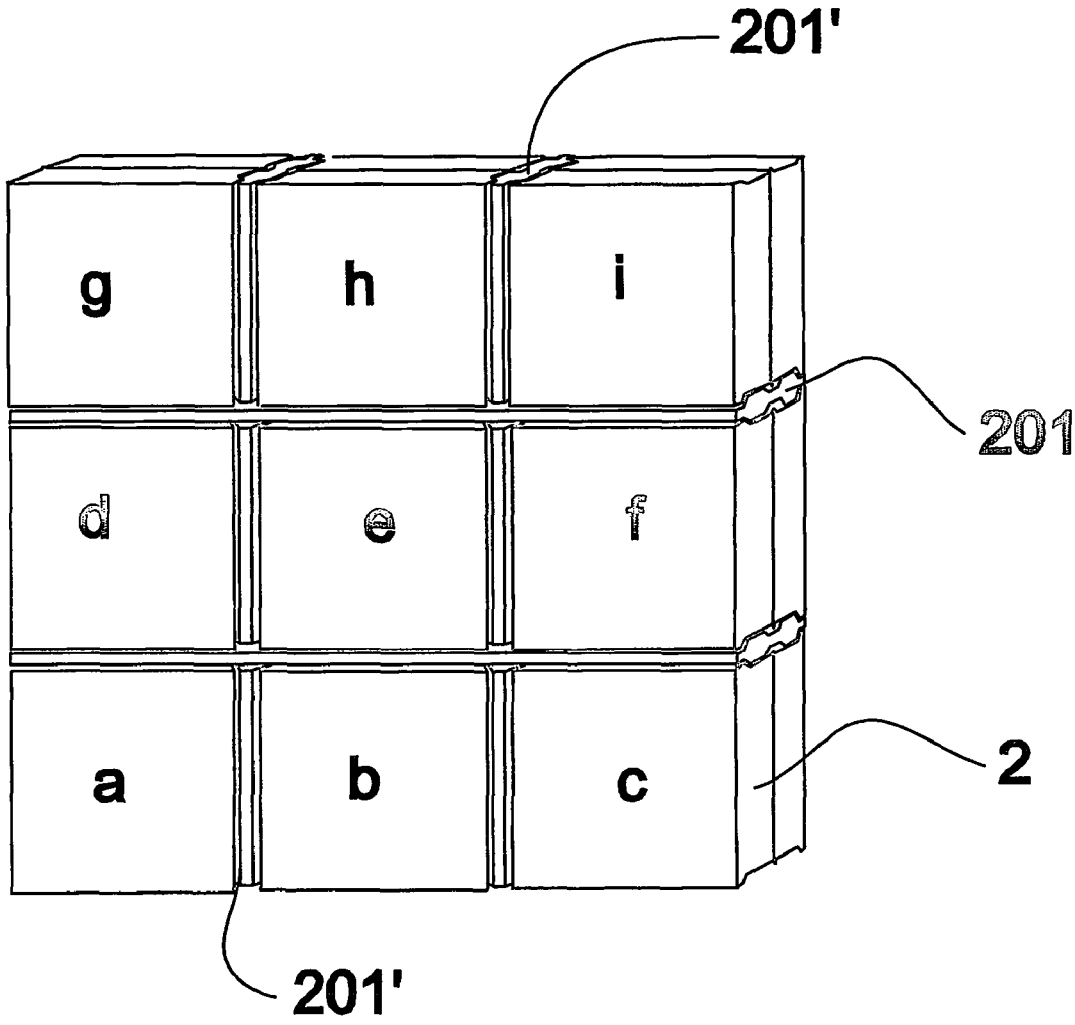
FIG. 6 shows a perspective view of a glass block wall built according to the present invention.

A wall constructed from a number of identical square glass blocks 2 using the spacing strip 201 is shown in FIG. 6. The wall comprises a first course of three glass blocks a,b,c, which may be attached to a floor or work surface by appropriate known means such as cementing or gluing. The lower edge of the first course may also be inserted into a profile or frame adapted to receive these blocks. A number of individual lengths of spacing strip 201' according to the present invention are inserted between adjacent blocks of the course. Strips 201' are pre-cut strips corresponding in length to a single side of a glass block 2.

After completing the first course, a second length of spacing strip 201 is cut to the desired length corresponding to three glass blocks 2. The cover sheet 222 is removed from a first side of the spacing strip 201 and the spacing strip 201 is applied to the first course of blocks with the exposed adhesive downwards. Next, the cover sheet 222 is removed from the second, upper side of the spacing strip 201 and a glass block d is placed onto the spacing strip aligned with the block a on the first course. The cover sheets 222 are removed from both sides of a further individual length of spacing strip 201' and the strip 201' is adhered to the side of the glass block d. The next glass block e can then be positioned above glass block b, adhering both on its lower surface and on its side surface. After applying a further strip 201' to the free side of glass block e, glass block f may be positioned and the wall is ready to receive the following horizontal spacing strip 201 and course of glass blocks g,h,i.

If the adhesive is of a reactive type, it may require further action to activate the reaction. Such action may include exposure to UV light or heat. If the adhesive is non reactive, the wall may be immediately ready for finishing. Finishing may involve the addition of grout 25 to the spaces between the glass blocks to seal the joints. Alternatively, other sealing means including but not limited to adhesives, caulking agent and additional plastic or rubber profile strips. Particularly, in constructions intended to be temporary, it may be desirable to use sealing or finishing means which is also easily removable. It is particularly advantageous that when using adhesives of the tacky variety, bond strength is immediate, and there is no limit to the number of courses, which may be constructed in a given operation.

While the above invention has been disclosed in the context of glass block walls, other constructions are equally possible, and the teachings of the present invention may be applied to structures built from blocks other than glass including stone, ceramics, composites, plastics and metals.

The invention claimed is:

1. A system for the construction of glass block walls, comprising an elongate, generally planar spacing strip of plastics material, having upper and lower surfaces forming an outer cross section generally corresponding in shape to an intended spacing between two adjacent blocks in the completed glass block wall construction, the spacing strip comprising a body portion having a first thickness and having a centrally disposed elongate channel on upper and lower surfaces thereof, and flange portions having a second thickness less than the first thickness, the flange portions extending laterally from the body portion, the flange portions are hollow, the spacing strip having a generally hollow interior with upper and lower walls, the system further comprising an adhesive for adhesion between the spacing strip and a glass block, wherein the adhesive is a one-component polymer adhesive that hardens by evaporation of a solvent and comprises groups which compatibilise the polymer with the plastics material.

2. The system according to claim 1, wherein the hollow interior is provided with transverse reinforcing webs between the upper and lower walls.

3. The system according to claim 1, wherein the adhesive contains a methylcyclohexane based solvent.

4. The system according to claim 1, wherein the adhesive is applied to the spacing strip or the glass block during manufacture.

5. The system according to claim 4 further comprising a removable protective layer covering the adhesive prior to use.

6. A glass block structure comprising:

a plurality of glass blocks arranged adjacent to one another, the glass blocks having a profile on their adjacent surfaces;

elongate, generally planar spacing strips of plastics material located between the adjacent glass blocks, the spacing strips having first and second surfaces generally corresponding in shape to the profile of the glass blocks; and a quantity of one component polymer adhesive adhering the spacing strips and glass blocks together wherein the adhesive hardens by evaporation of a solvent and comprises groups which compatibilise the polymer with the plastics material wherein the spacing strips comprise a body portion having a first thickness and having a centrally disposed elongate channel on upper and lower surfaces thereof, and flange portions having a second thickness less than the first thickness, the flange portions extending laterally from the body portion, the flange portions are hollow.

7. The structure according to claim 6, wherein the spacing strips comprise a hollow interior provided with transverse reinforcing webs.

8. A method of constructing a glass block wall using a system of elongate, generally planar spacing strip of plastics material, having upper and lower surfaces forming an outer cross section generally corresponding in shape to an intended spacing between two adjacent blocks in the completed glass block wall construction, the spacing strip comprising a body portion having a first thickness and having a centrally disposed elongate channel on upper and lower surfaces thereof, and flange portions having a second thickness less than the first thickness, the flange portions extending laterally from the body portion, the flange portions being hollow the spacing strip having a generally hollow interior with upper and lower walls, the system further comprising an adhesive for adhesion between the spacing strip and a glass block, wherein the adhesive is a one-component polymer adhesive that hardens by evaporation of a solvent and comprises groups which compatibilise the polymer with the plastics material, the method comprising:

placing a first course of glass blocks;

applying adhesive on a first side of the spacing strip;

placing the spacing strip on the first course of blocks;

placing adhesive on a second side of the spacing strip; and placing a further course of blocks on top of the spacing strip.

9. The method according to claim 8 further comprising placing individual lengths of spacing strip between adjacent blocks on the same course.

10. The method according to claim 8 further comprising grouting the joint between adjacent blocks.

11. The system according to claim 1, wherein the spacing strip is formed from polystyrene or a styrene based copolymer.

12. The system according to claim 1, wherein the adhesive comprises a polymer or copolymer or block (co) polymer having aliphatic or styrenic groups which compatibilise the polymer with styrene.

13. The structure according to claim 7, wherein the spacing strip is formed from polystyrene or a styrene based copolymer.

14. The structure according to claim 6, wherein the adhesive comprises a polymer or copolymer or block (co) polymer having aliphatic or styrenic groups which compatibilise the polymer with styrene.

* * * * *